United States Patent [19]

Kight

[11] Patent Number: 4,947,596

[45] Date of Patent: Aug. 14, 1990

[54] CLOSURE FOR ROOF VENT

[76] Inventor: Jerry D. Kight, 312 S. Spring St., Claxton, Ga. 30417

[21] Appl. No.: 354,865

[22] Filed: May 22, 1989

[51] Int. Cl.[5] ..... E02D 29/14

[52] U.S. Cl. ..... 52/202; 52/203; 52/219

[58] Field of Search ..... 52/199, 200, 202, 203, 52/219, 302, 305

[56] References Cited

U.S. PATENT DOCUMENTS

| | | | |
|---|---|---|---|
| 2,814,100 | 11/1957 | Lippman, Jr. | 52/203 X |
| 2,998,337 | 8/1961 | Tillotson | 52/223 R |
| 3,756,895 | 9/1973 | Bellamy | 52/199 X |
| 4,272,934 | 6/1981 | Cowden | 52/202 |
| 4,337,602 | 7/1982 | King | 52/202 |
| 4,544,587 | 10/1985 | Nesbitt | 52/202 X |
| 4,658,555 | 4/1987 | Steiner | 52/202 |

*Primary Examiner*—Richard E. Chilcot, Jr.
*Attorney, Agent, or Firm*—James B. Middleton

[57] ABSTRACT

A closure is provided for temporarily sealing a roof vent. The closure has a resilient core receivable within the opening of the vent, the core pressing against the sides of the vent to hold the closure in place. A mounting plate carries the core, and the mounting plate limits the entry of the core into the vent. The mounting plate also includes a handle for manipulation of the closure. The mounting plate is formed of somewhat stiff material. A center section receives the core, and opposed end sections have cutouts shaped to match the core, the end sections being folded over to hold the core in place. Staples or other fastening devices hold the end sections against the center section.

8 Claims, 2 Drawing Sheets

CLOSURE FOR ROOF VENT

INFORMATION DISCLOSURE STATEMENT

It is well known that vents are used through the roof of a building in order to remove heat from the attic. Removal of excess heat greatly reduces the energy required to cool a building to the desired degree. In residential buildings, it has become very common to utilize a turbine over the vent to allow hot air to escape and to prevent entry of rain, small animals and the like.

While these vents are quite effective in removing heat from the attic, and are very deisrable in hot weather, such vents have an adverse effect in cold weather. When one is attempting to heat a space, it is desirable to retain heat in the attic to prevent excessive heat loss through the ceiling of a building. As a result, several means have been devised in an effort to prevent heat loss through the unusal vents through the roof. The most common techniques amount to covering the hole through the roof by nailing a piece of sheet material over the hole, and placing a plastic bag or the like over the turbine on the roof. While each of these techniques may accomplish the ultimate purpose to some extent, both are troublesome and neither includes reasonable insulation.

SUMMARY OF THE INVENTION

This invention relates generally to closures, and is more particularly concerned with a temporary closure for a roof vent.

The present invention provides a core having insulating properties, the core being adapted to be snugly received within a vent opening. The core is fixed to a mounting plate for providing rigidity to the core and for holding the assembly together. In one embodiment the mounting plate also includes handle means to assist in insertion and removal of the core.

BRIEF DESCRIPTION OF THE DRAWINGS

These and other features and advantages of the present invention will become apparent from consideration of the following specification when taken in conjunction with the accompanying drawings in which.

DETAILED DESCRIPTION OF THE EMBODIMENT

Figure 1:
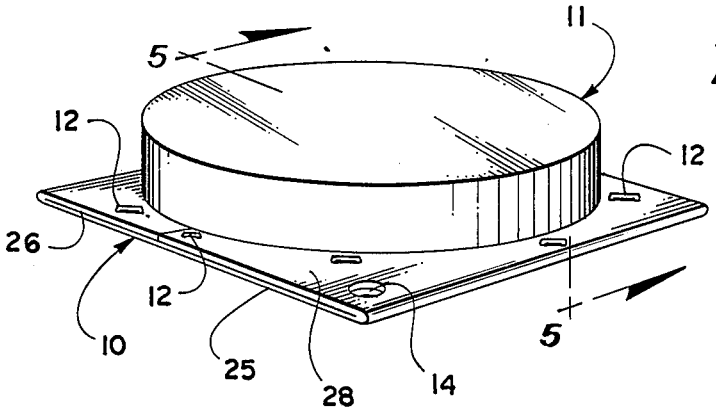
FIG. 1 is a perspective view of a closure member made in accordance with the present invention.

Referring now more partricularly to the drawings, and to that embodiment of the invention here presented by way of illustration, the device shown in FIG. 1 includes the mounting plate generally designated at 10 supporting a core generally designated at 11. There is a plurality of staples 12 for holding the assembly together, and a hole, such as the hole 14, may be provided to hang up the device either for storage or for merchandising display.

Figure 2:
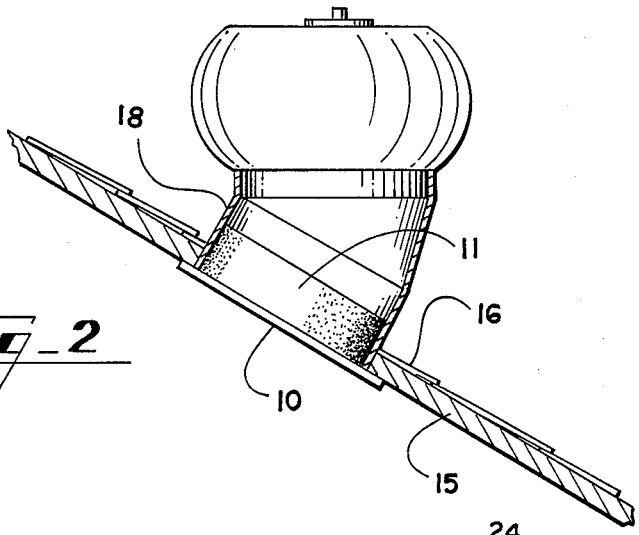
FIG. 2 is a fragmentary cross-sectional view in the device of FIG. 1 installed in a roof vent.

FIG. 2 of the drawings shows a roof structure 15 having an opening 16 therethrough. The opening 16 receives a pipe 18 that will carry a turbine or other structure designed to preclude entry of weather, small animals and debris. It will be seen that the core 11 is received within the pipe 18, and the mounting plate 10 acts as a stop to limit entry into the pipe 18. It is contemplated that the size of the core 11 will be such that the frictional engagement of the core 11 with the inside of the pipe 18 will be sufficient to retain the closure member in the pipe. Thus, to install the device of the present invention, one would simply urge the core 11 into the pipe 18 until the mounting plate 10 engages the roof structure 15. To remove the closure, one will simply grasp the handle and pull the closure from the pipe 18.

Though several materials will suggest themselves to those skilled in the art, it is contemplated that the core member 11 will include a dis made of exapanded polyurethane. Polyurethane is sufficiently elastic that the elastic force will easily hold the core 11 within the pipe 18. It will bde understood, however, that expanded polyurethane is not significantly waterproof; furthermore, some polyurethanes tend to hydrolyze and will decompose when subjected to sufficient moisture. The present invention therefore includes a moisture barrier surrounding the polyurethane disk.

Figure 3:
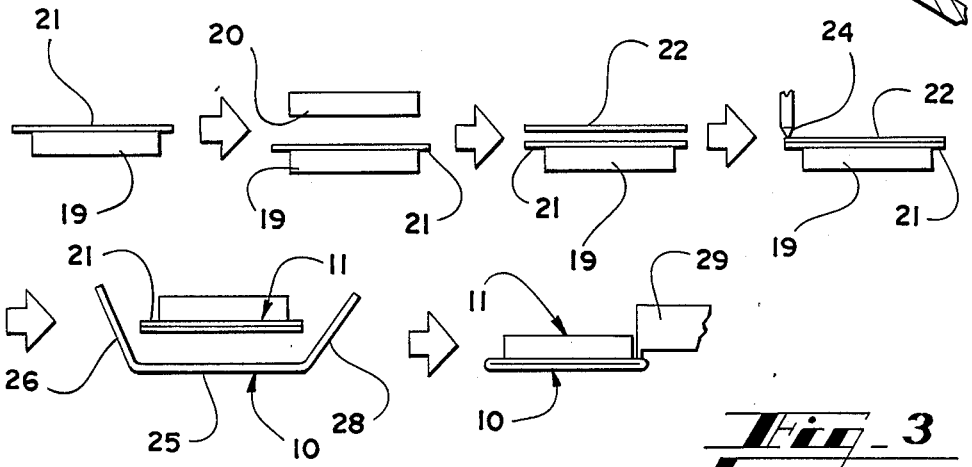
FIG. 3 is a shcematic illustration of the assembly of the device shown in FIG. 1.

For a better understanding of the construction of the closure of the present invention, attention is directed to FIG. 3 of the drawings which is a schematic representation of the steps involved in producing the closure member. In FIG. 3 it will be seen that there is a sheet of material formed into open pan or container 19. It is contemplated that the sheet will be polyethylene and preferably reasonably heavy, for example, 2 mil. Obviously, other moisture proof thermoplastics are equally usable. With the container 19 formed, a disc of expanded polyurethane 20 is placed into the container 19.

Those skilled in the art will understand that the closure of the present invention can be made in virtually any shape to be received within the vent opening to be closed. The device shown in FIG. 1 is by way of example, and includes a circular core 11 be received in the commonly used roof vents that use a 12 inch diameter pipe 18. With this construction, it is contemplated that the sheet material for making the container 19 will be a square sheet; and, the sheet is properly deformed to create the container 19. There will be a flange 21 surrounding the container 19.

Returning then to FIG. 3 of the drawings, the disk of polyurethane 20 is placed into the container 19, and a second sheet of polyethylene 22 is placed over the container 19, the sheet 22 being a aligned with the flange 21. With the sheet 22 in place, a heat sealing means designated at 24 will be utilized to seal the sheet 22 to the flange 21 of the container 19. After appropriate sealing, it will be understood that the polyurethane disk 20 is completely sealed within an enveloped of polyethylene or other moisture proof material.

With the core 11 thus formed, the mounting plate 10 is applied. The core 11 is placed on the central section 25 of the plate 10, and the end sections 2l and 28 are folded over, towards each other, to sandwich the flange 21 of the core 11 between the end selections 26 and 28 and the center section 25. Once the sections 26 and 28 are fully folded, stapling means 29 is used to apply staples such as the staples 12 to secure the structure together.

Figure 4:
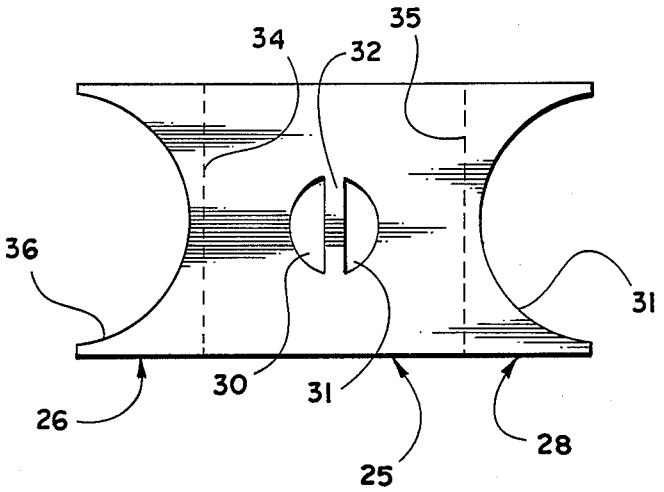
FIG. 4 is a plan view of the blank for making the mounting plate.

For a detailed understanding of the construction of the mounting plate 10, attention is directed to FIG. 4 of the drawings which shows a plan view of the blank for the base plate. In FIG. 4 it will be seen that the center section 25 and generally rectangular and includes a pair oft openings 30 and 31, defining a strip 32 therebetween. This construction produces the handle for easy manipulation of the closure of the present invention, the strip 32 constituting the handle for the closure device. At each edge of the center section 25, there are fold lines designated at 34 and 35 along whiich the end sections 26 and 28 are foledd.

The end sections 26 and 28 are mirror images of each other, and include cut outs 36 and 38, the radius of the cutouts 36 and 38 being substantially identical to the radius of the core 11. As a result, the core 11 with its flange 21 can be placed on the center section 25. The end sections 26 and 28 can then be folded towards the core member, and the cutouts 36 and 38 will receive the core member 11. The end sections 26 and 28 hold the core member in place. With the provision of some staples for retaining the end sections 26 and 28 against the center section 25, it will be understood that a durable closure member is provided.

Figure 5:
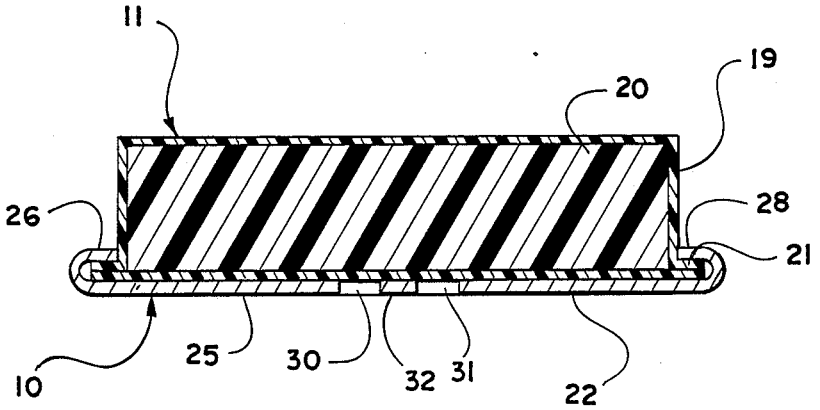
FIG. 5 is a cross-sectional view taken substantially along the line 5—5 in FIG. 1.

Looking at FIG. 5 of the drawings, the contemplated closure member is shown in cross-section to illustrate the construction. Here it will be seen that the container 19 and the sheet 22 provide a complete envelope for the polyurethane disk 20. The flanges 21 are heat sealed or otherwise fixed together to provide a bond. The mounting plate 10 is then fixed to the core member 11, the end sections 26 and 28 overlying the flanges 21 to provide a unitary structure. The handle 32 is easily available for ready manipulation of the device. Since the polyurethane disk 20 is very flexible, one can insert fingers through the openings 30 and 31 and depress the core member 11 sufficiently to achieve a good hold on the handle 32.

It will therefore be understood that the closure member of the present invention provides a very simple and economical means for temporarily closing a roof vent. The closure member can be made round as shown, or octogonal, rectangular or any other shape to fit the opening to be closed. While polyurethane has been discussed, other resilient materials can be used if desired. Polyurethane tends to take a compression set; however, polyurethane is quite inexpensive, and will last for a reasonable length of time before taking enough of a set to be unusable. It is contemplated that the mounting plate 10 will be made of fiber board or other relatively stiff material and it has been mentioned that the structure will be stapled together. Those skilled in the art wil understand that the mounting plate 10 might equally well be made of thermoplastic or the like, and the assembly cawn be heat sealed together. Even if the mounting plate 10 is made of fiber board, the use of thermoplastic for the flange 21 of the core member will allow heat sealing, the thermoplastic flange acting as the adhesive to secure the end members 26 and 28 in place.

It will therefore be understood by those skilled in the art that the particular embodiment of the invention here presented is by way of illustration only, and is meant to be in no way restrictive; therefore, numerous changes and modifications mey be made, and the full use of the equivalents resorted to, without departing from the spirit or scope of the invention as outlined in the appended claims.

What is claimed is:

1. A closure, for a roof vent or the like, said roof vent including a pipe extending through an opening in the roof and means carried by said pipe above the roof for preventing entry of weather and small animals, said closure including a core receivable within said pipe of said roof vent, said core being dimensioned to be received within said pipe, said core being formed of a flexible elastomeric material, and a mounting plate, said core being fixed to said mounting plate so that said mounting plate provides rigidity to said core, said core being sufficiently elastic to be retained within said pipe by the inherent elastic force of said elastomeric material.

2. A closure, as claimed in claim 1, said core comprising a disk of thermal uinsulating material, and an envelope enclosing said disk of thermal insulating material, and means for fixing said envelope to said mounting plate.

3. A closure, as claimed in claim 2, said thermal insulating material comprising an expanded polyurethane; said envelope comprising thermoplastic sheet sealed together for enclosing said disk.

4. A closure, as claimed in claim 1, said mounting plate including a center portion receiving said core, and side portions juxtapositioned on said center portion for holding said core of place.

5. A closure, for a roof vent or the like, said closure including a core receivable within said roof vent, and a mounting plate, said core being fixed to said mounting plate so that said mounting plate provides rigidity to said core, said core being sufficiently elastic to be retained within said roof vent by the inherent elastic force, said mounting plate including a center portion receiving said core, and side portions juxtapositioned on said center portion for holding said core in place, said side portions defining cutouts therein, said cutouts having a shape to receive said core therein.

6. A closure as claimed in claim 5, and including fastening means for fixing said side portions with respect to said center portion for holding said core in place on said mounting plate.

7. A closure as claimed in claim 6, said core comprising a disk of expanded plastic; said envelope comprising thermoplastic sheet material, and including flanges of said thermoplastic sheet material extending outwardly from said disk, said flanges being received between said center portion and said side portions.

8. A closure as claimed in claim 5, said center portion defining openings therein spaced apart for creating a strut therebetween, said strut constituting a handle for manipulating said closure.

* * * * *